US007919924B2

(12) United States Patent
Saitou et al.

(10) Patent No.: US 7,919,924 B2
(45) Date of Patent: Apr. 5, 2011

(54) MAGNETRON AND METHOD OF MANUFACTURING MAGNETRON ANODE VANE

(75) Inventors: Etsuo Saitou, Tochigi (JP); Nagisa Kuwahara, Tochigi (JP); Takeshi Ishii, Tochigi (JP)

(73) Assignee: Panasonic Corporation, Osaka (JP)

( * ) Notice: Subject to any disclaimer, the term of this patent is extended or adjusted under 35 U.S.C. 154(b) by 64 days.

(21) Appl. No.: 12/042,547

(22) Filed: Mar. 5, 2008

(65) Prior Publication Data

US 2009/0153055 A1 Jun. 18, 2009

(30) Foreign Application Priority Data

Dec. 12, 2007 (JP) ..... P. 2007-321082

(51) Int. Cl.
*H01J 25/50* (2006.01)

(52) U.S. Cl. ..... 315/39.51; 315/39.71; 315/39.75

(58) Field of Classification Search ..... 315/39.51, 315/39.53, 39.71, 39.75
See application file for complete search history.

(56) References Cited

U.S. PATENT DOCUMENTS

| | | | | |
|---|---|---|---|---|
| 3,904,919 | A * | 9/1975 | Farney et al. | 315/39.61 |
| 4,041,350 | A * | 8/1977 | Shitara et al. | 315/39.75 |
| 5,061,878 | A * | 10/1991 | Hall | 315/39.75 |
| 5,090,613 | A * | 2/1992 | Lee | 228/254 |
| 5,180,946 | A * | 1/1993 | Aiga et al. | 315/39.51 |
| 5,635,798 | A * | 6/1997 | Ogura et al. | 315/39.71 |
| 6,078,141 | A * | 6/2000 | Hoh | 315/39.75 |
| 6,841,940 | B2 * | 1/2005 | Brady et al. | 315/39.69 |
| 2002/0043937 | A1 * | 4/2002 | Ogura et al. | 315/39.51 |
| 2004/0140207 | A1 * | 7/2004 | Lee et al. | 204/298.14 |
| 2005/0174061 | A1 * | 8/2005 | Yoshihara et al. | 315/39.51 |

FOREIGN PATENT DOCUMENTS

| | | |
|---|---|---|
| JP | 61-285641 | 12/1986 |
| JP | 1-95442 | 4/1989 |
| KR | 2004009855 A * | 1/2004 |

OTHER PUBLICATIONS

Extended European Search Report issued in European Patent Application No. EP 08152299.7-2208, dated Jan. 26, 2009.

* cited by examiner

*Primary Examiner* — Douglas W Owens
*Assistant Examiner* — Tung X Le
(74) *Attorney, Agent, or Firm* — McDermott Will & Emery LLP

(57) ABSTRACT

In each anode vane 10, there is provided the brazing material spreading prevention groove 13 that interconnects the strap ring inserting portions 11 and 12 in parallel to the direction of the central axis Ax. With such a configuration, it is possible to prevent the residual brazing material 3*a* from spreading to the front end part 10*a* of the anode vane 10 when each anode vane 10 is brazed on the inner peripheral surface of the anode cylinder 1. Therefore, non-uniformity in thickness of the anode vanes 10 caused by the residual brazing material 3*a* is suppressed, and electrostatic capacity between the anode vanes 10 adjacent to each other becomes substantially constant. Thus, it is possible to obtain stable resonant frequency. In addition, it becomes easy to perform adjustment for obtaining the stable resonant frequency in that non-uniformity in initial frequency of the time when the magnetron is completely assembled decreases.

6 Claims, 8 Drawing Sheets

MAGNETRON AND METHOD OF MANUFACTURING MAGNETRON ANODE VANE

BACKGROUND OF THE INVENTION

1. Field of the Invention

The present invention relates to a magnetron used in microwave applications such as a microwave oven and a method of manufacturing an anode vane of the magnetron.

2. Description of the Related Art

FIG. 12 is a cross-sectional view illustrating a schematic structure of a known magnetron. In addition, FIG. 13 is a partial sectional perspective view illustrating an assembly state of the anode structure of the magnetron shown in FIG. 12. In FIGS. 12 and 13, a plurality of anode vanes 2 are brazed on an inner peripheral surface of an anode cylinder 1 by a high melting point brazing material 3 and are protruded toward a central axis of the anode cylinder 1. In the anode vanes 2, two large and small concentric strap rings 4*a* and 4*b* are alternately brazed on an upper end and a lower end thereof. In addition, in at least one of the anode vanes 2, a concave groove 5 is formed, and one end part of a microwave guide-out conductor 6 having a rod shape is brazed in the groove 5. In the one end part of the microwave guide-out conductor 6, a concave groove 7 (see FIG. 13) is formed, and the concave groove 7 is engaged with the concave groove 5. Since the plurality of the anode vanes 2 are formed in the same shape, the anode vanes 2 are arranged by alternately changing each direction thereof as much as 180 degrees so that the strap rings 4*a* and 4*b* are alternately brazed. Specifically, as shown in FIG. 13, the anode vane 2 of the front side is disposed so that the concave groove 5 faces downward, and the anode vane 2 of the back side is disposed so that the concave groove 5 faces upward. As described above, the anode vanes 2 are arranged by alternately changing each direction thereof.

The plurality of the anode vane 2 are arranged radially in the anode cylinder 1, and a cavity resonator is formed in an area surrounded by the anode vanes 2 neighboring to each other and the anode cylinder 1.

In a manufacturing process of the known magnetron mentioned above, by using the high melting point brazing material 3, the plurality of anode vanes 2 are brazed on the inner peripheral surface of the anode cylinder 1, the strap rings 4*a* and 4*b* are brazed to the anode vane 2, and the microwave guide-out conductor 6 is brazed to at least one anode vane 2, simultaneously. In this process, as shown in FIG. 14, sometimes, an excess portion of a brazing material 3*a* formed in a brazing process (hereinafter, it is referred to as a residual brazing material) may spread over a side face of the anode vane 2 or flow in the strap ring 4*a* side. When inflow amount of the residual brazing material 3*a* is large, it is difficult to obtain a stable resonating operation in a predetermined mode. Particularly, when the brazing material which is spread over the side face of the anode vane 2 connected to the microwave guide-out conductor 6 is protruded to an adjacent anode vane 2 side, there is a concern about local chaos in electric field caused by focusing high frequency electric field thereon. In addition, there are a lot of cases where amount of the residual brazing material 3*a* is different for each anode vane 2, and thus the non-uniformity thereof have a great adverse effect on a resonant frequency.

To solve the problems mentioned above, in Patent Document 1, a brazing material inducing groove is provided on the side face of the anode vane having a plate shape protruded from the brazing portion formed on the inner peripheral surface of an anode cylinder to the center of the anode cylinder, and is extended in the range from a brazing portion of an anode cylinder at least to a groove for inserting the microwave guide-out conductor. By providing the brazing material inducing groove, the residual of the melted brazing material is guided into the inducing groove when the anode vane is brazed to the anode cylinder. Therefore, it is possible to prevent the brazing material from being spread lower than the inducing groove.

Patent Document 1: Japanese Unexamined Patent Application Publication No, H01-95442

Although the brazing material inducing groove is provided on the side face of the anode vane toward the central axis, sometimes the residual brazing material may spread from the brazing portion of the anode cylinder of a lower side of the groove in the central axis direction of the anode vane, or may overflow from the groove to the lower side of the anode vane. Thus, there is a concern about occurrence of non-uniformity in characteristics, that is, non-uniformity in the resonant frequency. Inventors of the invention found the fact that the resonant frequency is greatly affected when the residual brazing material spread to a part of the front end of the anode vane. Accordingly, as shown in FIG. 15, it is necessary to configure the residual brazing material as not to spread to the front end part 2*a* of the anode vane 2.

SUMMARY OF THE INVENTION

The invention has been made in consideration of the situation mentioned above, and its object is to provide a magnetron configured so that the residual brazing material does not spread to the front end part of the anode vane and a method of manufacturing the anode vane of the magnetron.

In the invention, there is provided a magnetron including an anode cylinder, and a plurality of anode vanes that are brazed on an inner peripheral surface of the anode cylinder. In the magnetron, each of the anode vanes has at least one brazing material spreading prevention groove for interconnecting a lower end and an upper end of the anode vane.

According to the configuration, the brazing material spreading prevention groove prevents the residual brazing material from spreading to the front end part of the anode vane when the anode vane is brazed on the inner peripheral surface of the anode cylinder. Therefore, non-uniformity in thickness of the anode vanes caused by the residual brazing material is suppressed, and electrostatic capacity between the anode vanes adjacent to each other becomes substantially constant. Thus, it is possible to obtain stable resonant frequency. In addition, it becomes easy to perform adjustment for obtaining the stable resonant frequency in that non-uniformity in initial frequency of the time when the magnetron is completely assembled decreases.

In the configuration, the anode vane has at least one first brazing material guiding groove for interconnecting an end of the anode vane brazed to the anode cylinder and the brazing material spreading prevention groove.

According to the configuration, the first brazing material guiding groove collects the residual brazing material and is guided to the brazing material spreading prevention groove. Therefore, it is possible to prevent the residual brazing material from spreading, in front of the residual brazing material spreading prevention groove.

In the configuration, the anode vane has a first strap ring inserting portion in which a strap ring is to be brazed and which is formed in a groove shape on a upper end close to the central axis in a lengthwise direction, and a second strap ring inserting portion in which a strap ring is to be brazed and which is formed in a groove shape on a lower end close to the central axis in a lengthwise direction. In addition, one end of the brazing material spreading prevention groove reaches the first strap ring inserting portion, and the other end thereof reaches the second strap ring inserting portion.

According to the configuration, the residual brazing material is guided to a part for brazing the strap ring in the strap ring inserting portion of the anode vane. Therefore, it is possible to enhance brazing the anode vane to the strap rings.

In the configuration, the anode vane has a concave groove in which an end of a microwave guide-out conductor is to be brazed. In addition, each of both surfaces of the anode vane has at least one second brazing material guiding groove for interconnecting the concave groove and the brazing material guiding groove.

According to the configuration, the residual brazing material is guided to the concave groove for brazing one end of the microwave guide-out conductor. Therefore, it is possible to enhance brazing the anode vane to the microwave guide-out conductor.

In the invention, there is provided a magnetron including an anode cylinder, and a plurality of anode vanes which are arranged radially from a central axis of the anode cylinder and are brazed on an inner peripheral surface of the anode cylinder. In the magnetron, each of both surfaces of the anode vane has a large number of fine concave and convex portions arranged thereon as a whole in the range from a front end of the anode vane to an end of the anode vane brazed on an inner peripheral surface of the anode cylinder.

According to the configuration, the large number of fine concave and convex portions is arranged on the surfaces thereof as a whole in the range from the front end of the anode vane to the end of the anode vane brazed on the inner peripheral surface of the anode cylinder. Thus, it is possible to prevent the residual brazing material from spreading to the front end part of the anode vane when the anode vane is brazed on the inner peripheral surface of the anode cylinder. Therefore, non-uniformity in thickness of the anode vanes caused by the residual brazing material is suppressed, and electrostatic capacity between the anode vanes adjacent to each other becomes substantially constant. Thus, it is possible to obtain stable resonant frequency. In addition, it becomes easy to perform adjustment for obtaining the stable resonant frequency in that non-uniformity in initial frequency of the time when the magnetron is completely assembled decreases.

In the invention, there is provided a method of manufacturing an anode vane of a magnetron including an anode cylinder, and a plurality of anode vanes which are arranged radially from a central axis of the anode cylinder and are brazed on an inner peripheral surface of the anode cylinder. The method includes a step of forming on the anode vane at least one brazing material spreading prevention groove for interconnecting a lower end of the anode vane and a upper end thereof close to the central axis.

According to the configuration, the brazing material spreading prevention groove is formed on the anode vane, and thus it is possible to prevent the residual brazing material from spreading to the front end part of the anode vane when the anode vane is brazed on the inner peripheral surface of the anode cylinder. Thereby, non-uniformity in thickness of the anode vanes caused by the residual brazing material is suppressed, and electrostatic capacity between the anode vanes adjacent to each other becomes substantially constant. Thus, it is possible to obtain stable resonant frequency. In addition, it becomes easy to perform adjustment for obtaining the stable resonant frequency in that non-uniformity in initial frequency of the time when the magnetron is completely assembled decreases.

According to invention, it is possible to prevent the residual brazing material from spreading to the front end part of the anode vane when the anode vane is brazed on the inner peripheral surface of the anode cylinder. Therefore, non-uniformity in thickness of the anode vanes caused by the residual brazing material is suppressed, and electrostatic capacity between the anode vanes adjacent to each other becomes substantially constant. Thus, it is possible to obtain stable resonant frequency. In addition, it becomes easy to perform adjustment for obtaining the stable resonant frequency in that non-uniformity in initial frequency of the time when the magnetron is completely assembled decreases.

DESCRIPTION OF THE PREFERRED EMBODIMENTS

Hereinafter, preferred embodiments of the invention will be described with reference to the drawings.

Embodiment 1

Figure 1:
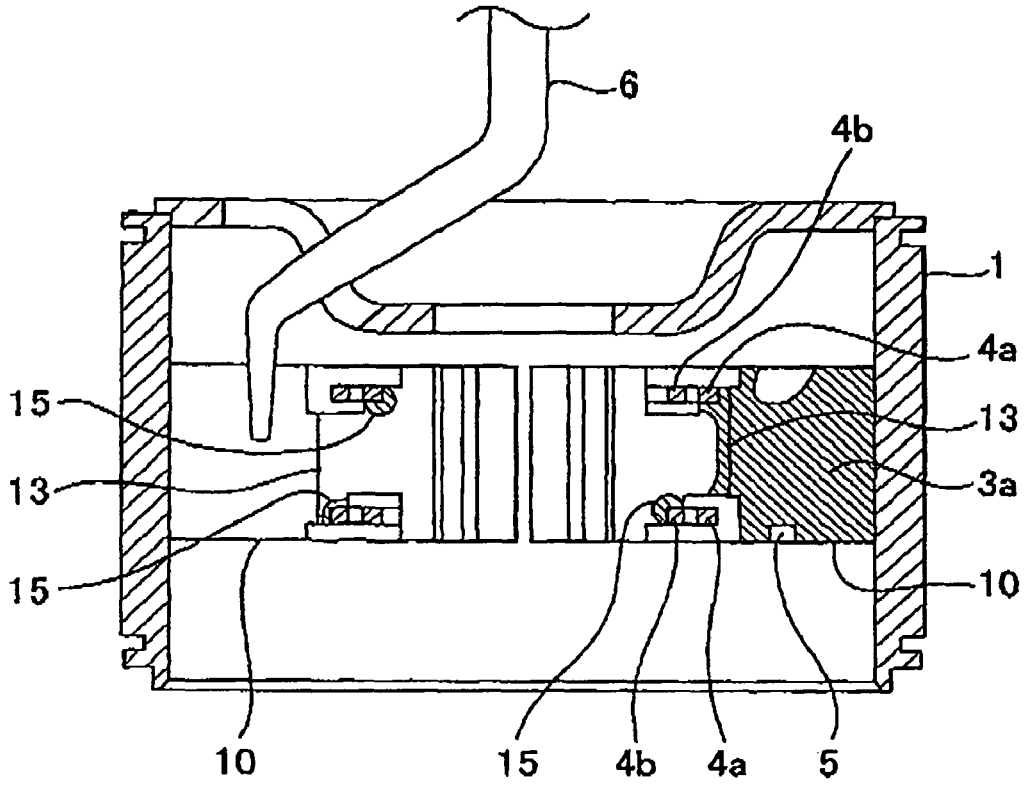
FIG. 1 is a cross-sectional view illustrating a schematic structure of a magnetron according to an embodiment 1 of the invention.
Figure 2A:
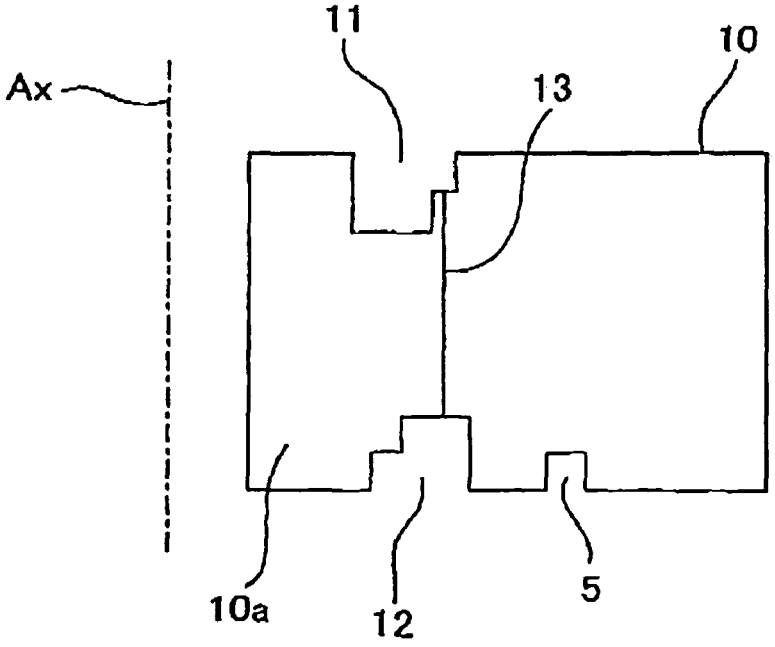
FIG. 2*a* is a view illustrating an anode vane of a magnetron according to an embodiment 1 of the invention.
Figure 12:
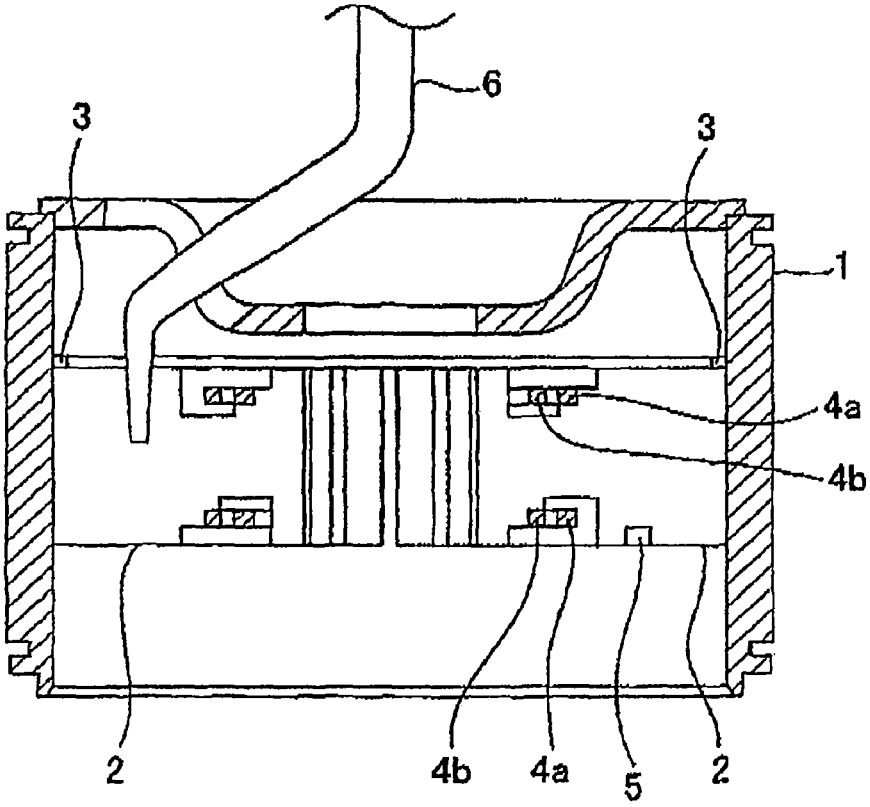
FIG. 12 PRIOR ART
FIG. 12 is a cross-sectional view illustrating a known magnetron.
Figure 13:
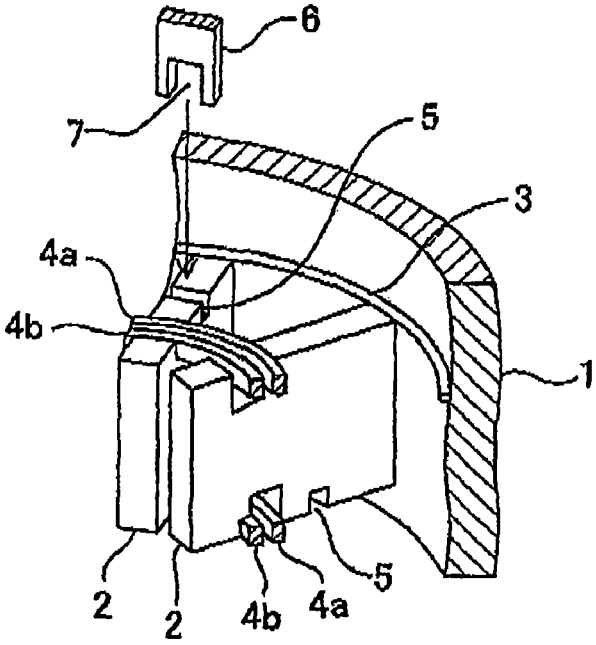
FIG. 13 PRIOR ART
FIG. 13 is a partial sectional perspective view illustrating an assembly state of the anode structure of the magnetron shown in FIG. 12.
Figure 14:
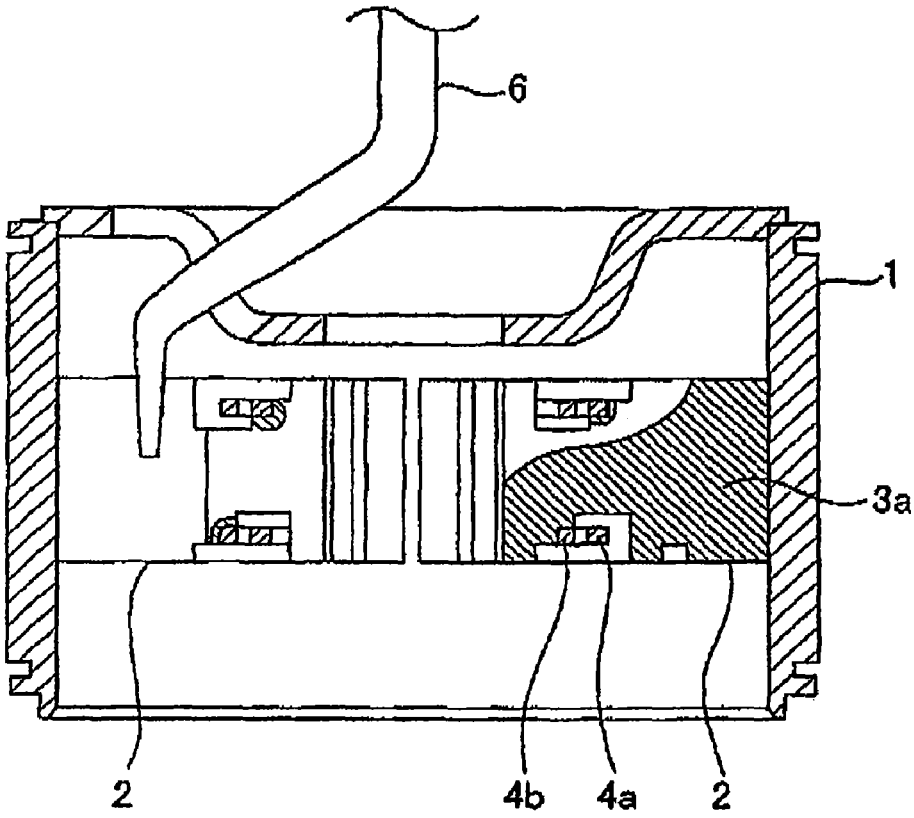
FIG. 14 PRIOR ART
FIG. 14 is a cross-sectional view illustrating the magnetron shown in FIG. 12.
Figure 15:
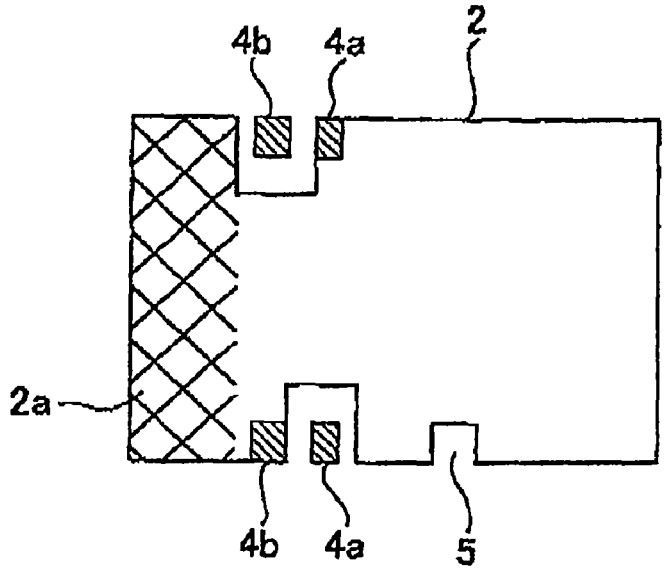
FIG. 15 PRIOR ART
FIG. 15 is a view illustrating the anode vane of the magnetron shown in FIG. 12.

FIG. 1 is a cross-sectional view illustrating a schematic structure of the magnetron according to an embodiment 1 of the invention. In this drawing, common elements with FIG. 12 described above will be referenced by the same reference numerals and signs. The magnetron of the embodiment has an anode vane 10 configured so that a residual brazing material 3*a* does not spread to a front end part 10*a*. The anode vane 10 is shown in FIG. 2*a*. As shown in this drawing, the anode vane 10 includes a linear groove 13 (hereinafter, it is referred to as a 'brazing material spreading prevention groove') formed parallel to a direction of a central axis Ax between strap ring inserting portions 11 and 12. The strap ring inserting portions 11 and 12 are formed in a groove shape on an upper end and a lower end close to the central axis Ax in a lengthwise direction. The brazing material spreading prevention groove 13 is provided on one surface or both surfaces of the anode vane 10. In the respective surfaces, the brazing material spreading prevention groove 13 prevents the residual brazing material 3*a* from spreading to the front end part 10*a* of the anode vane 10 when the anode vane 10 is brazed on the inner peripheral surface of the anode cylinder 1 with a high melting point brazing material 3 (see FIG. 13).

By preventing the residual brazing material 3*a* from spreading to the front end part 10*a* of the anode vane 10, non-uniformity in thickness of the front end part 10*a* of the anode vanes 10 is suppressed, and electrostatic capacity between the anode vanes 10 adjacent to each other becomes substantially constant. Thus, it is possible to obtain stable resonant frequency. In addition, it becomes easy to perform adjustment for obtaining the further stable resonant frequency in that non-uniformity in resonant frequency (namely, initial frequency) of the time when the magnetron is completely assembled decreases.

Meanwhile, a pair of large and small strap rings 4*a* and 4*b* has a brazing material layer (not shown in the drawing) that is formed on surface thereof by plating. The brazing material layer is melted when the layer is heat by putting in a furnace, and is brazed to the anode vane 10. The reference numeral 15 in FIG. 1 represents a brazing material melted down from the surface of the strap rings 4*a* and 4*b*. When the residual brazing material 3*a* spreads over the brazing material spreading prevention groove 13, the spreading enhances fixation between the anode vane 10 and the strap ring 4*a* disposed on the upper side of the anode vane 10.

As described above, in each anode vane 10, there is provided the brazing material spreading prevention groove 13 that interconnects the strap ring inserting portions 11 and 12 in parallel to the direction of the central axis Ax. Therefore, it is possible to prevent the residual brazing material 3*a* from spreading to the front end part 10*a* of the anode vane 10 when each anode vane 10 is brazed on the inner peripheral surface of the anode cylinder 1. In addition, it is possible to enhance brazing the anode vane 10 to the strap ring 4*a* provided on the upper side or the lower side (since the strap ring is alternately brazed) of each anode vane 10.

Figure 3:
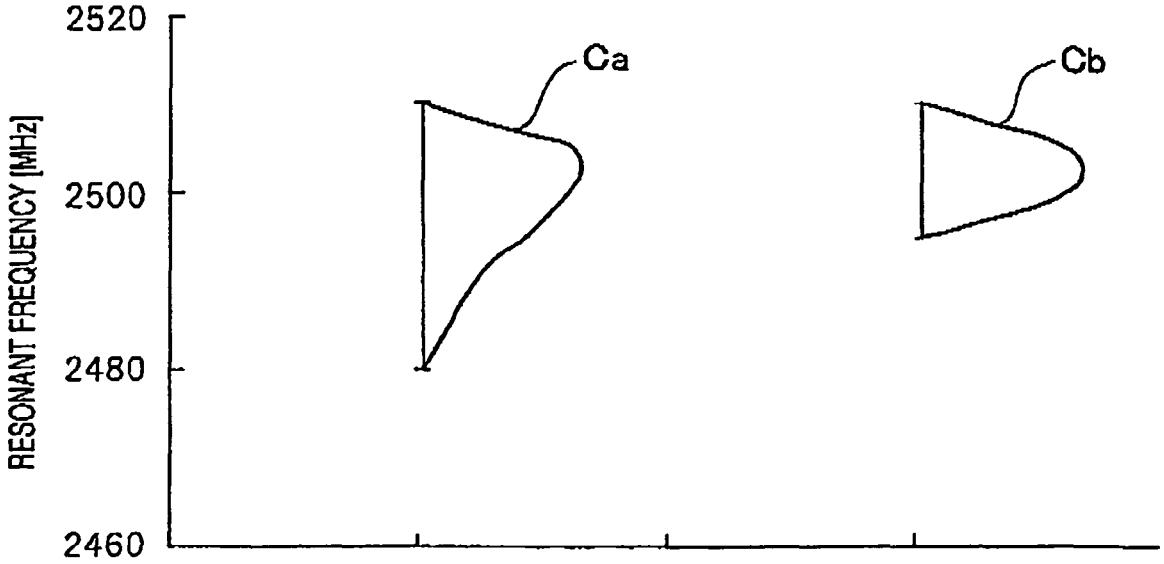
FIG. 3 is a view illustrating resonant frequency difference between the known magnetron and the magnetron according to the invention.

FIG. 3 is a view illustrating resonant frequency difference between the known magnetron and the magnetron according to the invention. The curve Ca represents a resonant frequency characteristic of the known magnetron, and the curve Cb represents a resonant frequency characteristic of magnetron according to the invention. As shown in the drawing, non-uniformity in resonant frequency decreases in the magnetron of the invention.

According to the magnetron of the invention as described above, in each anode vane 10, there is provided the brazing material spreading prevention groove 13 that interconnects the strap ring inserting portions 11 and 12 in parallel to the direction of the central axis Ax. Therefore, it is possible to prevent the residual brazing material 3*a* from spreading to the front end part 10*a* of the anode vane 10 when each anode vane 10 is brazed on the inner peripheral surface of the anode cylinder 1. Accordingly, non-uniformity in thickness of the front end part 10*a* of the anode vanes 10 caused by the residual brazing material 3*a* is suppressed, and electrostatic capacity between the anode vanes 10 adjacent to each other becomes substantially constant. Thus, it is possible to obtain stable resonant frequency. Moreover, it becomes easy to perform adjustment for obtaining the further stable resonant frequency.

In addition, it is possible to enhance brazing the anode vane 10 to the strap ring 4*a* provided on the upper side or the lower side of each anode vane 10.

Figure 2B:
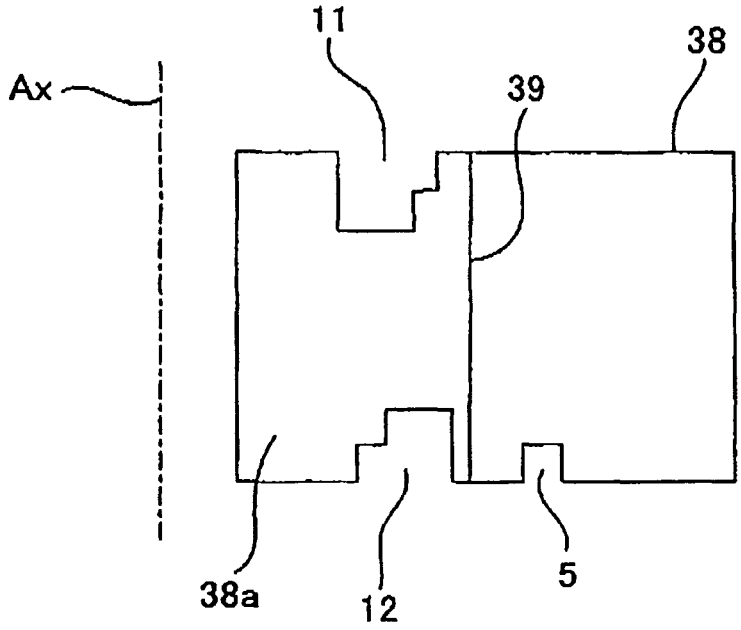
FIG. 2*b* is a view illustrating other example of an anode vane of the magnetron according to an embodiment 1 of the invention.

In the anode vane 10 shown in FIG. 2*a*, the brazing material spreading prevention groove 13 is formed parallel to a direction of a central axis Ax between strap ring inserting portions 11 and 12 that are formed in a groove shape on an upper end and a lower end close to the central axis Ax in a lengthwise direction. However, the brazing material spreading prevention groove 13 may be formed on any one position closer to a position to be blazed on the inner peripheral surface of the anode cylinder 1 than the strap ring inserting portions 11 and 12. As shown in FIG. 2*b*, in the anode vane 38, the brazing material spreading prevention groove 39 is formed on a position closer to a position to be blazed on the inner peripheral surface of the anode cylinder 1 than the strap ring inserting portions 11 and 12 that are formed in a groove shape on the upper end and the lower end close to the central axis Ax in the lengthwise direction. As described above, in each anode vane 38 there is provided the brazing material spreading prevention groove 13 that interconnects the upper end and the lower end close to the central axis Ax in the lengthwise direction. Therefore, it is possible to prevent the residual brazing material 3*a* from spreading to the front end part 38*a* of the anode vane 38 when each anode vane 38 is brazed.

Embodiment 2

Figure 4:
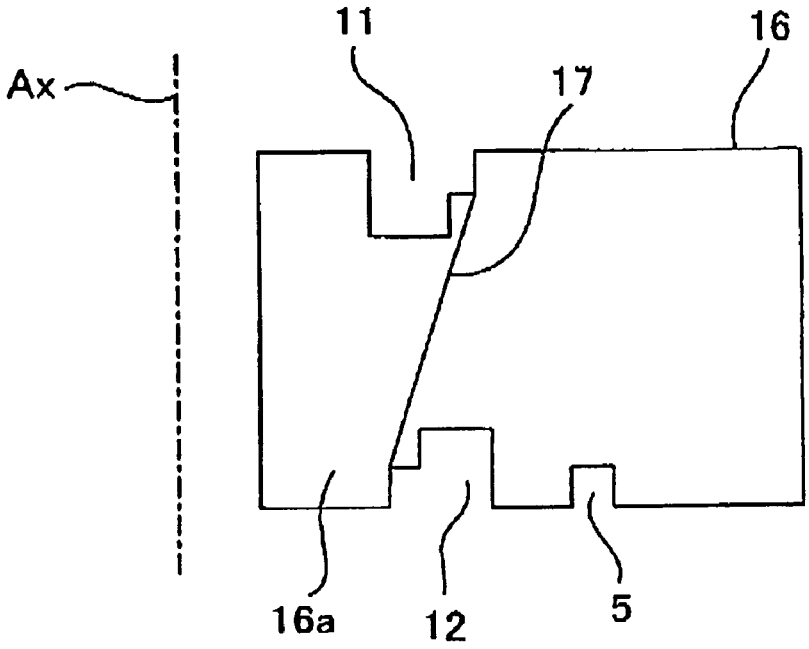
FIG. 4 is a view illustrating an anode vane of a magnetron according to an embodiment 2 of the invention.

FIG. 4 is a view illustrating an anode vane of the magnetron according to an embodiment 2 of the invention. In this drawing, common elements with FIG. 2*a* described above will be referenced by the same reference numerals and signs. The magnetron of the embodiment, in the same manner as the magnetron of the embodiment 1, has an anode vane 16 configured so that a residual brazing material 3*a* does not spread to a front end part 16*a*.

In the anode vane 16, there is provided a linear groove 17 (hereinafter, it is referred to as a 'brazing material spreading prevention groove') that interconnects a part of a strap ring inserting portion 11 for brazing a strap ring 4*a* and a part of a strap ring inserting portion 12 for brazing a strap ring 4*b*. The strap ring inserting portion 11 is formed in a groove shape on an upper end close to the central axis Ax in a lengthwise direction, and the strap ring inserting portion 12 is formed in a groove shape on a lower end close to the central axis Ax in the lengthwise direction.

The brazing material spreading prevention grooves 17 are provided on both surfaces of the anode vane 16. In the respective surfaces, the brazing material spreading prevention groove 17 prevents the residual brazing material 3*a* from spreading to the front end part 16*a* of the anode vane 16 when the anode vane 16 is brazed on the inner peripheral surface of the anode cylinder 1. In addition, in the brazing material spreading prevention groove 17, one end thereof reaches the part of the strap ring inserting portion 11 for brazing the strap ring 4*a*, and the other end thereof reaches the part of the strap ring inserting portion 12 for brazing the strap ring 4*b*. Therefore, brazing the anode vane 16 to the strap rings 4*a* and 4*b* are enhanced by the guided residual brazing material 3*a*.

By interconnecting the part of the strap ring inserting portion 11 for brazing the strap ring 4*a* and the part of the strap ring inserting portion 12 for brazing the strap ring 4*b*, the brazing material spreading prevention groove 17 is inclined with respect to a widthwise direction of the anode vane 16. However, it is possible to prevent the residual brazing material 3*a* from spreading without any problem.

Embodiment 3

Figure 5:
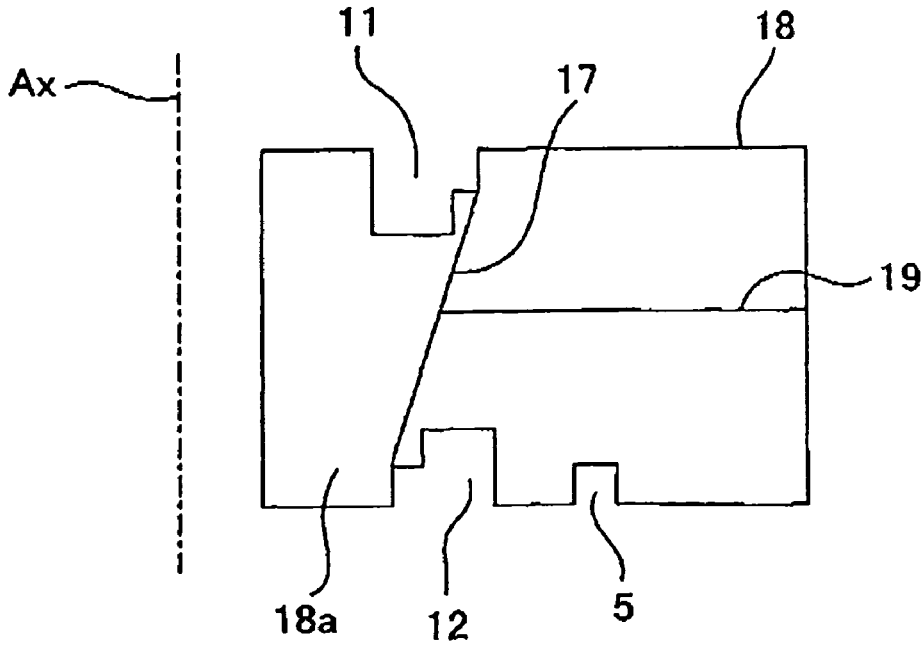
FIG. 5 is a view illustrating an anode vane of a magnetron according to an embodiment 3 of the invention.

FIG. 5 is a view illustrating an anode vane of the magnetron according to an embodiment 3 of the invention. In this drawing, common elements with FIG. 4 described above will be referenced by the same reference numerals and signs. The magnetron of the embodiment, in the same manner as the magnetron of the embodiments 1 and 2, has an anode vane 18 configured so that a residual brazing material 3*a* does not spread to a front end part 18*a*.

The anode vane 18 includes not only the residual brazing material spreading prevention groove 17, which is the same as that of the anode vane 16 of the magnetron according to the embodiment 2, but also a residual brazing material guiding portion 19 which collects the residual brazing material 3*a* and guides the material to the residual brazing material spreading prevention groove 17. The residual brazing material guiding portion 19 is parallel to the lengthwise direction of the anode vane 18, and is formed in a linear shape that interconnects a center part of the end of the anode vane 18 brazed on the inner peripheral surface of the anode cylinder 1 and a substantially center part of the residual brazing material spreading prevention groove 17.

The residual brazing material spreading prevention groove 17 and the residual brazing material guiding groove 19 are provided on both surfaces of the anode vane 18. Thereby, in the respective surfaces, it is possible to prevent the residual brazing material 3*a* from spreading to the front end part 18*a* of the anode vane 18 when the anode vane 18 is brazed on the inner peripheral surface of the anode cylinder 1. In addition, it is possible to enhance brazing the anode vane 18 to the strap rings 4*a* and 4*b*.

Figure 6:
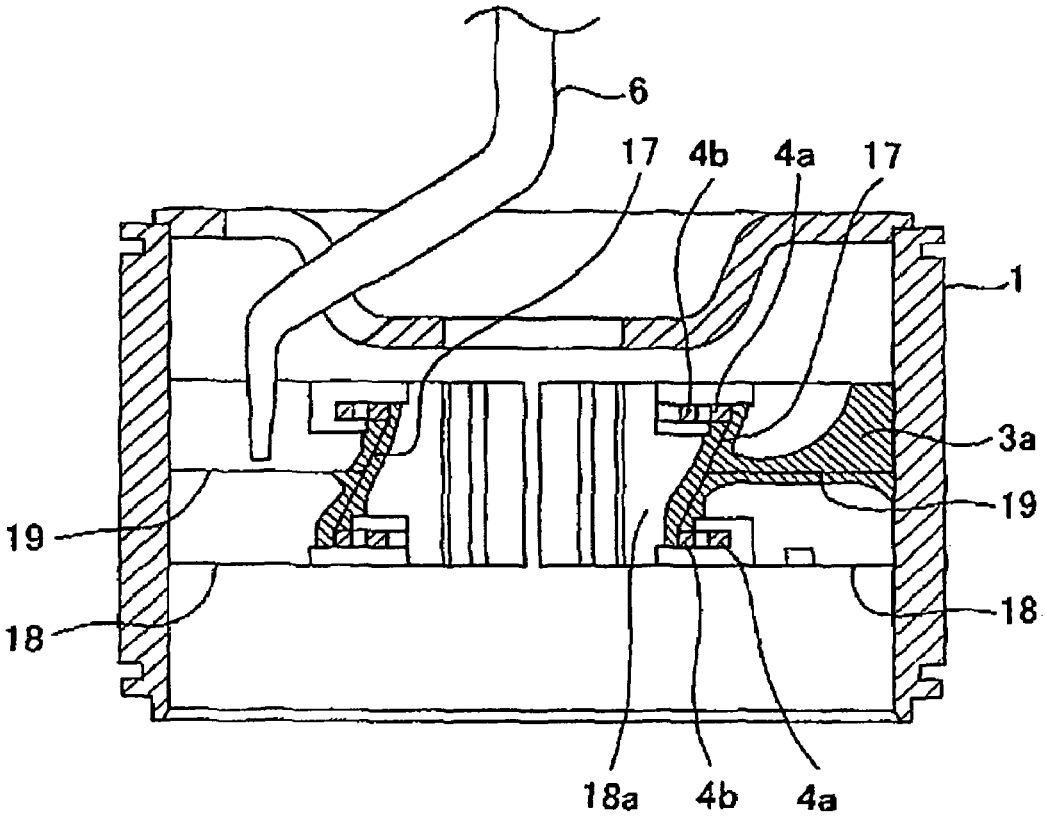
FIG. 6 is a cross-sectional view illustrating a schematic structure of a magnetron according to the embodiment 3 of the invention.

FIG. 6 is a cross-sectional view illustrating a schematic structure of a magnetron assembled according to the embodiment. As shown in this drawing, the residual brazing material 3*a* spreads while collecting in the residual brazing material guiding portion 19, and is guided to the residual brazing material spreading prevention groove 17. In this case, the residual brazing material is prevented from spreading, in front of the residual brazing material spreading prevention groove 17. The residual brazing material 3*a* guided to the residual brazing material spreading prevention groove 17 reaches the part of the strap ring inserting portion 11 for brazing the strap ring 4*a* and the part of the strap ring inserting portion 12 for brazing the strap ring 4*b* in the anode vane 18, and enhances brazing the anode vane 18 to the strap rings 4*a* and 4*b*.

Embodiment 4

Figure 7:
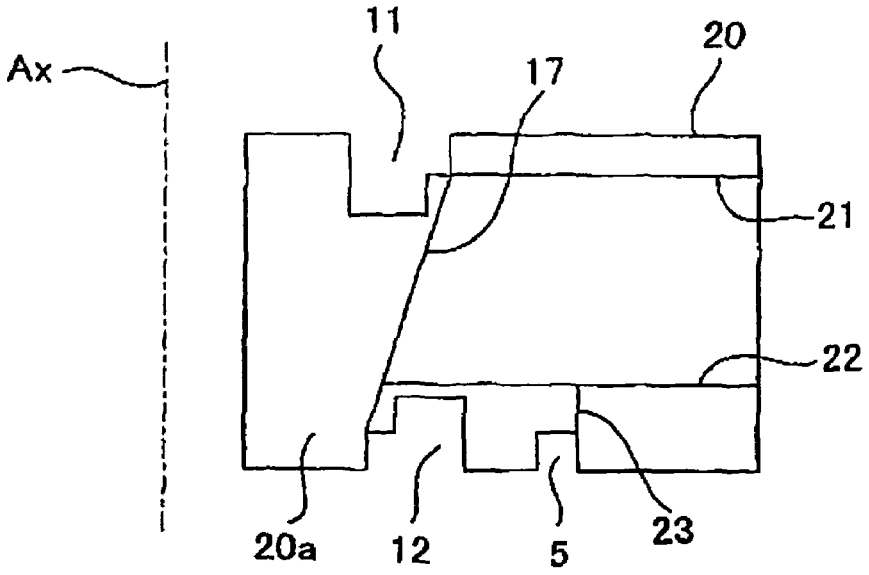
FIG. 7 is a view illustrating an anode vane of a magnetron according to an embodiment 4 of the invention.

FIG. 7 is a view illustrating an anode vane of a magnetron according to an embodiment 4 of the invention. In FIG. 7, common elements with FIG. 5 described above will be referenced by the same reference numerals and signs. The magnetron of the embodiment, in the same manner as the magnetron of the embodiments 1 to 3, has an anode vane 20 configured so that a residual brazing material 3*a* does not spread to a front end part 20*a*.

The anode vane 20 includes the residual brazing material spreading prevention groove 17 that is the same as that of the anode vane 16 of the magnetron according to the embodiment 2, a residual brazing material guiding groove 21 that is formed in a linear shape to interconnect a part of the strap ring inserting portion 11 for brazing the strap ring 4*a* in the anode vane 20 and an upper part of the end brazed on the inner peripheral surface of the anode cylinder 1 of the anode vane 20. Also included is a residual brazing material guiding groove 22 that is formed in a linear shape to interconnect a lower part of the residual brazing material spreading prevention groove 17 and a lower part of the end brazed on the inner peripheral surface of the anode cylinder 1 of the anode vane 20, and a residual brazing material guiding groove 23 that is formed in a linear shape to interconnect a substantially center part of the residual brazing material guiding groove 22 and the concave groove 5 for brazing the end of the microwave guide-out conductor 6.

The residual brazing material spreading prevention groove 17, the residual brazing material guiding groove 21, the residual brazing material guiding groove 22, and the residual brazing material guiding groove 23 are provided on each of the both surfaces of the anode vane 20. Thereby, in the respective surfaces, it is possible to prevent the residual brazing material 3*a* from spreading to the front end part 20*a* of the anode vane 20 when the anode vane 20 is brazed on the inner peripheral surface of the anode cylinder 1. In addition, it is possible to enhance brazing the anode vane 20 to the strap rings 4*a* and 4*b* and the end of the microwave guide-out conductor 6.

Embodiment 5

Figure 8:
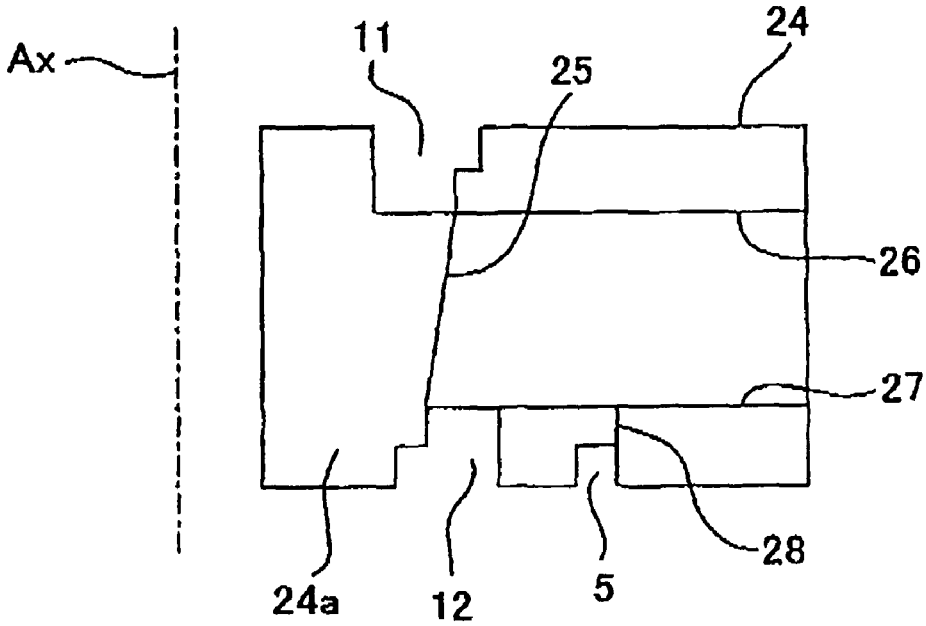
FIG. 8 is a view illustrating an anode vane of a magnetron according to an embodiment 5 of the invention.

FIG. 8 is a view illustrating an anode vane of a magnetron according to an embodiment 5 of the invention. In this drawing, common elements with FIG. 2*a* described above will be referenced by the same reference numerals and signs. The magnetron of the embodiment, in the same manner as the magnetron of the embodiments 1 to 4, has an anode vane 24 configured so that a residual brazing material 3*a* does not spread to a front end part 24*a*.

The anode vane 24 includes a residual brazing material spreading prevention groove 25 that is formed in a linear shape to interconnect a part directly under the part of the strap ring inserting portion 11 for brazing the strap ring 4*a* in the anode vane 24 and a part directly under the part of the strap ring inserting portion 12 for brazing the strap ring 4*b* in the anode vane 24, and a residual brazing material guiding groove 26 that is formed in a linear shape to interconnect a part directly under the part of the strap ring inserting portion 11 for brazing the strap ring 4*a* and an upper part of the end brazed on the inner peripheral surface of the anode cylinder 1 of the anode vane 24. Also included is a residual brazing material guiding groove 27 that is formed in a linear shape to interconnect a lower part of the residual brazing material spreading prevention groove 25 and a lower part of the end brazed on the inner peripheral surface of the anode cylinder 1 of the anode vane 24, and a residual brazing material guiding groove 28 that is formed in a linear shape to interconnect a substantially center part of the residual brazing material guiding groove 27 and the concave groove 5 for brazing the end of the microwave guide-out conductor 6.

The residual brazing material spreading prevention groove 25, the residual brazing material guiding groove 26, the residual brazing material guiding groove 27, and the residual brazing material guiding groove 28 are provided on each of the both surfaces of the anode vane 24. Thereby, in the respective surfaces, it is possible to prevent the residual brazing material 3*a* from spreading to the front end part 24*a* of the anode vane 24 when the anode vane 24 is brazed on the inner peripheral surface of the anode cylinder 1. In addition, it is possible to enhance brazing the anode vane 24 to the strap rings 4*a* and 4*b* and the end of the microwave guide-out conductor 6.

Embodiment 6

Figure 9:
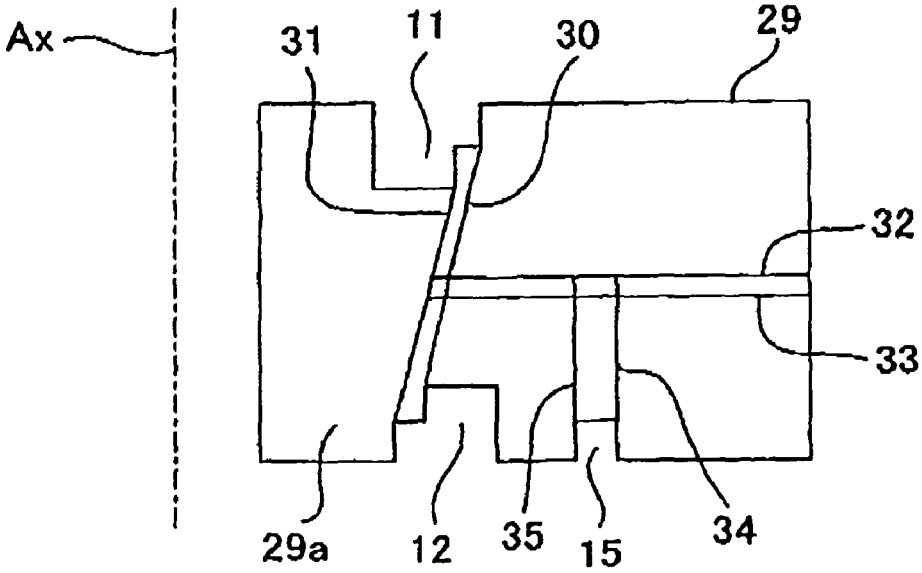
FIG. 9 is a view illustrating an anode vane of a magnetron according to an embodiment 6 of the invention.

FIG. 9 is a view illustrating an anode vane of a magnetron according to an embodiment 6 of the invention. In this drawing, common elements with FIG. 2*a* described above will be referenced by the same reference numerals and signs. The magnetron of the embodiment, in the same manner as the magnetron of the embodiments 1 to 5, has an anode vane 29 configured so that a residual brazing material 3*a* does not spread to a front end part 29*a*.

The anode vane 29 includes a residual brazing material spreading prevention groove 30 that is formed in a linear shape to interconnect a part of the strap ring inserting portion 11 for brazing the strap ring 4*a* in the anode vane 29 and a part directly under the part of the strap ring inserting portion 12 for brazing the strap ring 4*b* in the anode vane 29, and a residual brazing material spreading prevention groove 31 that is formed in a linear shape to interconnect a part directly under the part of the strap ring inserting portion 11 for brazing the strap ring 4*a* in the anode vane 29 and a part of the strap ring inserting portion 12 for brazing the strap ring 4*b* in the anode vane 29. Also included is a residual brazing material guiding groove 32 that is formed in a linear shape to interconnect substantially center parts of the residual brazing material spreading prevention grooves 30 and 31 and a substantially center part of the end brazed on the inner peripheral surface of the anode cylinder 1 of the anode vane 29, a residual brazing material guiding groove 33 that is located under the residual brazing material guiding groove 32 and is formed in a linear shape to interconnect substantially center parts of the residual brazing material spreading prevention grooves 30 and 31 and a substantially center part of the end brazed on the inner peripheral surface of the anode cylinder 1 of the anode vane 29. Also included is a residual brazing material guiding groove 34 that is formed in a linear shape to interconnect substantially center parts of the residual brazing material guiding groove 32 and 33 and one edge in the concave groove 15 for brazing the end of the microwave guide-out conductor 6 in the direction of the central axis Ax, and a residual brazing material guiding groove 35 that is formed in a linear shape to interconnect substantially center parts of the residual brazing material guiding groove 32 and 33 and the other edge of the concave groove 15 for brazing the end of the microwave guide-out conductor 6 in the direction of the central axis Ax.

The residual brazing material spreading prevention grooves 30 and 31, the residual brazing material guiding grooves 32 to 34 are provided on each of the both surfaces of the anode vane 29. Thereby, in the respective surfaces, it is possible to prevent the residual brazing material 3*a* from spreading to the front end part 29*a* of the anode vane 29 when the anode vane 29 is brazed on the inner peripheral surface of the anode cylinder 1. In addition, it is possible to enhance brazing the anode vane 29 to the strap rings 4*a* and 4*b* and the end of the microwave guide-out conductor 6.

Figure 10:
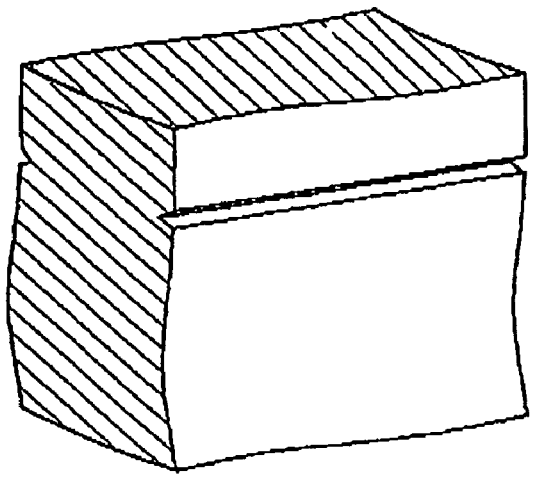
FIG. 10 is a perspective view illustrating an example of a groove formed in a magnetron according to the invention.

In the magnetron according to the embodiments 1 to 6, it is preferred that sections of the grooves 13, 17, 19, 21, 22, 25, 26, 27, 28, 30, 31, 32, 33, 34, and 35 formed on the anode vanes 10, 16, 18, 20, 24, and 29 have a V shape suitable to easily guide the spreading, as shown in FIG. 10.

Embodiment 7

Figure 11:
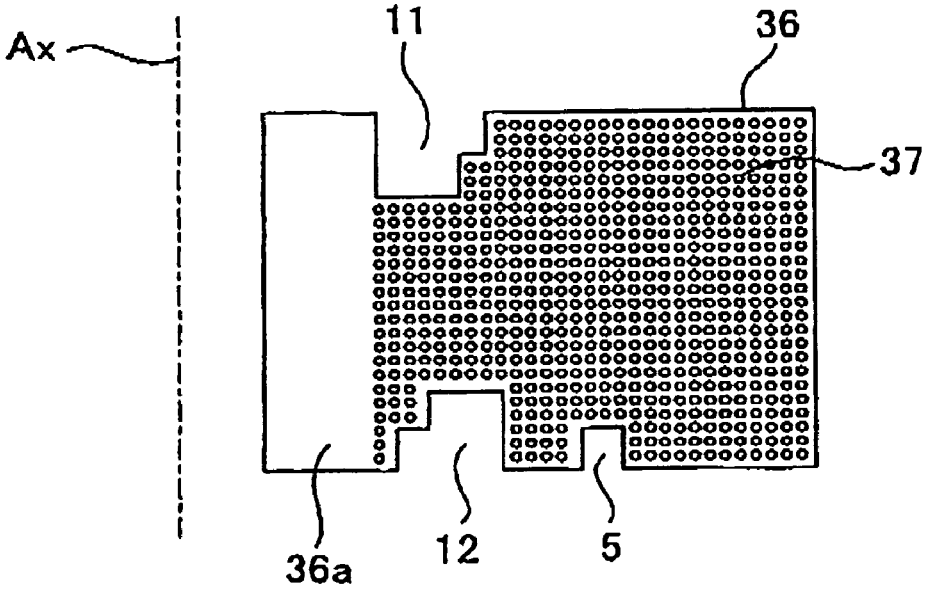
FIG. 11 is a view illustrating an anode vane of a magnetron according to an embodiment 7 of the invention.

FIG. 11 is a view illustrating an anode vane of a magnetron according to an embodiment 7 of the invention. In this drawing, common elements with FIG. 2*a* described above will be referenced by the same reference numerals and signs. The magnetron of the embodiment, in the same manner as the magnetron of the embodiments 1 to 6, has an anode vane 36 configured so that a residual brazing material 3*a* does not spread to a front end part 36*a*.

In the anode vane 36, each of both surfaces thereof has a large number of fine concave and convex portions 37 arranged thereon as a whole in the range from the front end 36*a* of the anode vane 36 to the end of the anode vane 36 brazed on the inner peripheral surface of the anode cylinder 1. The fine concave and convex portions 37 are provided on each of the both surfaces of the anode vane 36. Thereby, in the respective surfaces, it is possible to prevent the residual brazing material 3*a* from spreading to the front end part 36*a* of the anode vane 36 when the anode vane 36 is brazed on the inner peripheral surface of the anode cylinder 1. In addition, it is possible to enhance brazing the anode vane 36 to the strap rings 4*a* and 4*b* and the end of the microwave guide-out conductor 6.

The embodiments 1 to 7 do not limit a shape and a position of the concave and convex portions and the groove portions that prevent the residual brazing material 3*a* from spreading to the front end part of the anode vane in the magnetron according to the invention.

The invention has an advantage of preventing the residual brazing material from spreading to the front end part of the anode vane in the magnetron, and is useful in a magnetron used in microwave applications such as a microwave oven and a method of manufacturing an anode vane of the magnetron.

What is claimed is:

1. A magnetron comprising:

an anode cylinder; and a plurality of anode vanes which are brazed on an inner peripheral surface of the anode cylinder, wherein each of the anode vanes has at least one brazing material spreading prevention groove formed therein so as to define a reduced-thickness region, said at least one brazing material spreading prevention groove for interconnecting a lower end and an upper end of the anode vane.

2. The magnetron according to claim 1, wherein the anode vane has at least one first brazing material guiding groove for interconnecting an end of the anode vane brazed to the anode cylinder and the brazing material spreading prevention groove.

3. The magnetron according to claim 1, wherein the anode vane has a first strap ring inserting portion in which a strap ring is to be brazed and which is formed in a groove shape on the upper end close to the central axis in a lengthwise direction, and a second strap ring inserting portion in which a strap ring is to be brazed and which is formed in a groove shape on the lower end close to the central axis in a lengthwise direction, and wherein one end of the brazing material spreading prevention groove reaches the first strap ring inserting portion, and the other end thereof reaches the second strap ring inserting portion.

4. The magnetron according to claim 2 or claim 3, wherein the anode vane has a concave groove in which an end of a microwave guide-out conductor is to be brazed, and wherein each of both surfaces of the anode vane has at least one second brazing material guiding groove for interconnecting the concave groove and the brazing material guiding groove.

5. A magnetron comprising:

an anode cylinder; and a plurality of anode vanes which are arranged radially from a central axis of the anode cylinder and are brazed on an inner peripheral surface of the anode cylinder, wherein each of both side surfaces of the anode vane has a front end part which does not have a plurality of each of concave and convex portions arranged thereon, and has a plurality of each of concave and convex portions arranged thereon as a whole in the range from the front end part of the anode vane to an end of the anode vane brazed on an inner peripheral surface of the anode cylinder.

6. A method of manufacturing an anode vane of a magnetron including an anode cylinder, and a plurality of anode vanes which are arranged radially from a central axis of the anode cylinder and are brazed on an inner peripheral surface of the anode cylinder, the method comprising a step of forming in the anode vane at least one brazing material spreading prevention groove so as to define a reduced-thickness region, said at least one brazing material spreading prevention groove for interconnecting a lower end of the anode vane and an upper end thereof.

* * * * *